US005964294A

United States Patent [19]

Edwards et al.

[11] Patent Number: 5,964,294

[45] Date of Patent: Oct. 12, 1999

[54] APPARATUS AND METHOD FOR ORIENTING A DOWNHOLE TOOL IN A HORIZONTAL OR DEVIATED WELL

[75] Inventors: A. Glen Edwards, Hockley; Klaus B. Huber, Sugarland, both of Tex.

[73] Assignee: Schlumberger Technology Corporation, Sugar Land, Tex.

[21] Appl. No.: 08/760,390

[22] Filed: Dec. 4, 1996

[51] Int. Cl.[6] ..... E21B 43/119

[52] U.S. Cl. ..... 166/297; 166/50; 166/55.1; 166/242.6; 175/4.51

[58] Field of Search ..... 166/297, 50, 55.1, 166/242.6; 175/4.51

[56] References Cited

U.S. PATENT DOCUMENTS

| | | | |
|---|---|---|---|
| 3,047,313 | 7/1962 | Bruce | 175/320 |
| 3,167,137 | 1/1965 | Humphrey | 175/320 |
| 3,730,282 | 5/1973 | Chapman . | |
| 4,194,577 | 3/1980 | Vann . | |
| 4,269,278 | 5/1981 | Vann . | |
| 4,278,138 | 7/1981 | Rowley et al. | 175/320 |
| 4,410,051 | 10/1983 | Daniel et al. . | |
| 4,438,810 | 3/1984 | Wilkinson . | |
| 4,523,649 | 6/1985 | Stout . | |
| 4,586,847 | 5/1986 | Stanton | 404/117 |
| 4,637,478 | 1/1987 | George . | |
| 4,768,597 | 9/1988 | Lavigne et al. . | |
| 4,830,120 | 5/1989 | Stout . | |
| 4,844,161 | 7/1989 | Rankin et al. . | |
| 5,010,964 | 4/1991 | Cornette . | |
| 5,033,553 | 7/1991 | Miszewski et al. . | |
| 5,040,619 | 8/1991 | Jordan et al. . | |
| 5,103,912 | 4/1992 | Flint . | |
| 5,107,927 | 4/1992 | Whiteley et al. | 166/50 |
| 5,217,714 | 6/1993 | Jordan et al. . | |
| 5,484,029 | 1/1996 | Eddison | 175/73 |
| 5,603,379 | 2/1997 | Henke et al. | 175/4.51 |

*Primary Examiner*—Hoang Dang
*Attorney, Agent, or Firm*—Jeffrey E. Griffin; Gordon G. Waggett; John J. Ryberg

[57] ABSTRACT

A tool for performing a downhole function in a horizontal or highly deviated well has a downhole structure with a longitudinal axis and constructed to turn about the axis in response to a moment applied about the axis. The structure includes at least one ballast chamber containing a flowable inert ballast material, such that the gravitational center of the material-containing chamber is effectively offset from the longitudinal axis of the structure to enable the chamber to contribute to gravitational orientation of the tool within the well to a desired position. In another configuration, the structure is rotatable within a housing and supported by bearings. The chamber is preferably filled with tungsten or depleted uranium powder for maximum density. A swivel for use with the tool, capable of passing both hydraulic pressure and detonation waves, decreases the overall length of the rotating part of the tool string. The method of using an offset ballast to desirably orient a tool in a horizontal or highly deviated well is also disclosed.

22 Claims, 5 Drawing Sheets

APPARATUS AND METHOD FOR ORIENTING A DOWNHOLE TOOL IN A HORIZONTAL OR DEVIATED WELL

BACKGROUND OF THE INVENTION

This invention relates to tools for performing downhole functions in horizontal or highly deviated wells, and to rotating one or more downhole tools to desired orientations before performing the associated functions.

In a product recovery well, such as in the oil and gas industry, several downhole functions must be performed with tools lowered through the well pipe or casing. These tools may include, depending on the required tasks to be performed, perforating guns to produce holes in the well pipe wall to access a target formation, well-sealing tools, sensors and valves.

Many wells are drilled at an angle to vertical, or have a vertical upper portion and a lower portion that deviates substantially from vertical. Depending upon the angle of inclination of the well, such wells are referred to as horizontal or highly deviated wells. The tools used in these wells are often tubing-conveyed, i.e. lowered into the well bore on the end of multiple sections of tubing or a long metal tube from a coil, and activated by pressurizing the interior of the tubing.

Due to properties of some geologic formations and well casing structural considerations, better methods of controlling the accurate positioning of downhole tools are desirable. A horizontal well perforated on the lower side of the casing, for instance, can be less likely to become plugged with flowing sand, or to cause the collapse of the adjacent formation, than one perforated on its upper side.

SUMMARY OF THE INVENTION

In one aspect of the invention, a tool for performing a downhole function in a horizontal or highly deviated well comprises a downhole structure having a longitudinal axis and constructed to turn about the axis in response to a moment applied about the axis. The structure includes at least one ballast chamber containing a flowable inert ballast material, the chamber being carried by the structure such that the gravitational center of the material-containing chamber is effectively offset from the longitudinal axis of the structure to enable the chamber to contribute to gravitational orientation of the tool within the well to a desired position.

Preferred embodiments contain one or more of the following features: the structure comprises a rotatable tube; the chamber is elongated, with an axis of the chamber lying substantially parallel to and offset from the axis of the structure; and the flowable material comprises high density particulate material filling the chamber.

In another aspect of the invention, a system for performing a downhole function in a horizontal or highly deviated well comprises a downhole structure having a longitudinal axis, a swivel rotatably supporting the structure from uphole and enabling the structure to rotate about the axis upon application of a moment about the axis, and an internal ballast within the structure having a material density greater than about 500 pounds per cubic foot. The ballast is effectively offset to the axis to enable the ballast to contribute to rotation of the structure about the axis due to gravitational forces, to align the structure in a desired orientation within the well.

In some embodiments of the invention, the ballast material is selected from the group of chemical elements having a material density greater than about 500 pounds per cubic foot. In the preferred embodiments, the ballast material is selected from the group of chemical elements having a material density greater than about 1000 pounds per cubic foot. In the presently preferred configuration, the ballast comprises either tungsten or depleted uranium, preferably in a particulate, flowable form.

In another aspect of the invention, a downhole gun for perforating the casing of a horizontal or highly deviated well has a housing with a longitudinal axis, and a loading tube within the housing. The loading tube has at least one perforating charge arranged to perforate the casing, and at least one ballast chamber offset from the axis and containing inert ballast to contribute to rotation of the gun about the axis under gravitational forces until the chamber is positioned generally below the axis, to orient the charge to perforate the well casing in a preferred direction.

In yet another aspect, a downhole gun for perforating the casing of a horizontal or highly deviated well is provided, comprising a housing having a longitudinal axis, and a loading tube within the housing. The loading tube comprises at least one perforating charge arranged to perforate the casing, and a ballast weight comprising either tungsten or depleted uranium offset from the axis to contribute to rotation of the gun about the axis under gravitational forces until the weight is positioned generally below the axis, to orient the charge to perforate the well casing in a preferred direction.

In another aspect of the invention, a tool for performing a downhole function in a horizontal or highly deviated well has a housing with a longitudinal axis, and a freely rotatable structure within the housing. The structure has, along with any members it carries, a gravitational center effectively offset from the axis to contribute to rotation of the structure with respect to the housing about the axis under gravitational forces, to orient the structure in a preferred direction with respect to the well.

In a preferred embodiment, at least one low friction bearing supports the structure within the housing to enable free rotation of the structure with respect to the housing. In the present configuration, at least two spaced apart ball or roller bearings are employed.

In another embodiment, the structure contains a ballast weight positioned such that the gravitational center of the ballast weight is effectively offset from the longitudinal axis of the housing, preferably containing a flowable ballast material.

In a particularly useful configuration, the structure comprises a loading tube containing at least one perforating charge arranged to perforate the well. Preferably, the perforating charge is positioned within the loading tube such that the gravitational center of the charge is effectively offset from the longitudinal axis of the housing to contribute to rotation of the loading tube with respect to the housing about the axis under gravitational forces until the charge is positioned generally below the axis, to orient the charge in a preferred direction with respect to the well.

In other embodiments, the frame is constructed to define at least a first and a second cavity for carrying perforating charges, the first cavity containing a perforating charge and the second cavity containing a ballast weight. The cavities are arranged to orient the charge in a preferred direction under gravitational forces.

In another embodiment, the tool of the invention has a rotatable seal between the structure and the housing. In a preferred configuration, a rotatable seal is employed at each of a first and a second end of the structure, the structure defining an internal hydraulic path between the first end and the second end.

In another aspect of the invention, a string of tools for performing a downhole function in a horizontal or highly deviated well includes a detonatable tool with a through-passing hydraulic line and a longitudinal axis, a hydraulically activated firing head for detonating the tool (the firing head located above the tool in the string), and a swivel between the tool and the firing head. The swivel is constructed to transfer a detonation wave from the firing head to the tool to detonate the tool. The swivel also defines a through-passing hydraulic path to transfer activating hydraulic pressure from the firing head to the hydraulic line of the tool. The swivel enables the tool to rotate about the axis with respect to the firing head when a moment is applied to the tool about the axis.

In preferred embodiments, the detonatable tool has a gravitational center effectively offset from the axis to contribute to rotation of the tool with respect to the firing head about the axis under gravitational forces, to orient the tool in a preferred direction with respect to the well.

In another aspect of the invention a method of orienting a tool in a horizontal or highly deviated well comprises filling a ballast chamber with a flowable ballast material, placing the ballast chamber into a swivelable tool housing having a longitudinal axis (with the gravitational center of the filled chamber effectively offset from the axis), and lowering the housing into the well, enabling the housing to rotate under gravitational forces acting upon the offset gravitational center of the filled chamber.

DESCRIPTION OF THE PREFERRED EMBODIMENTS

Figure 1:
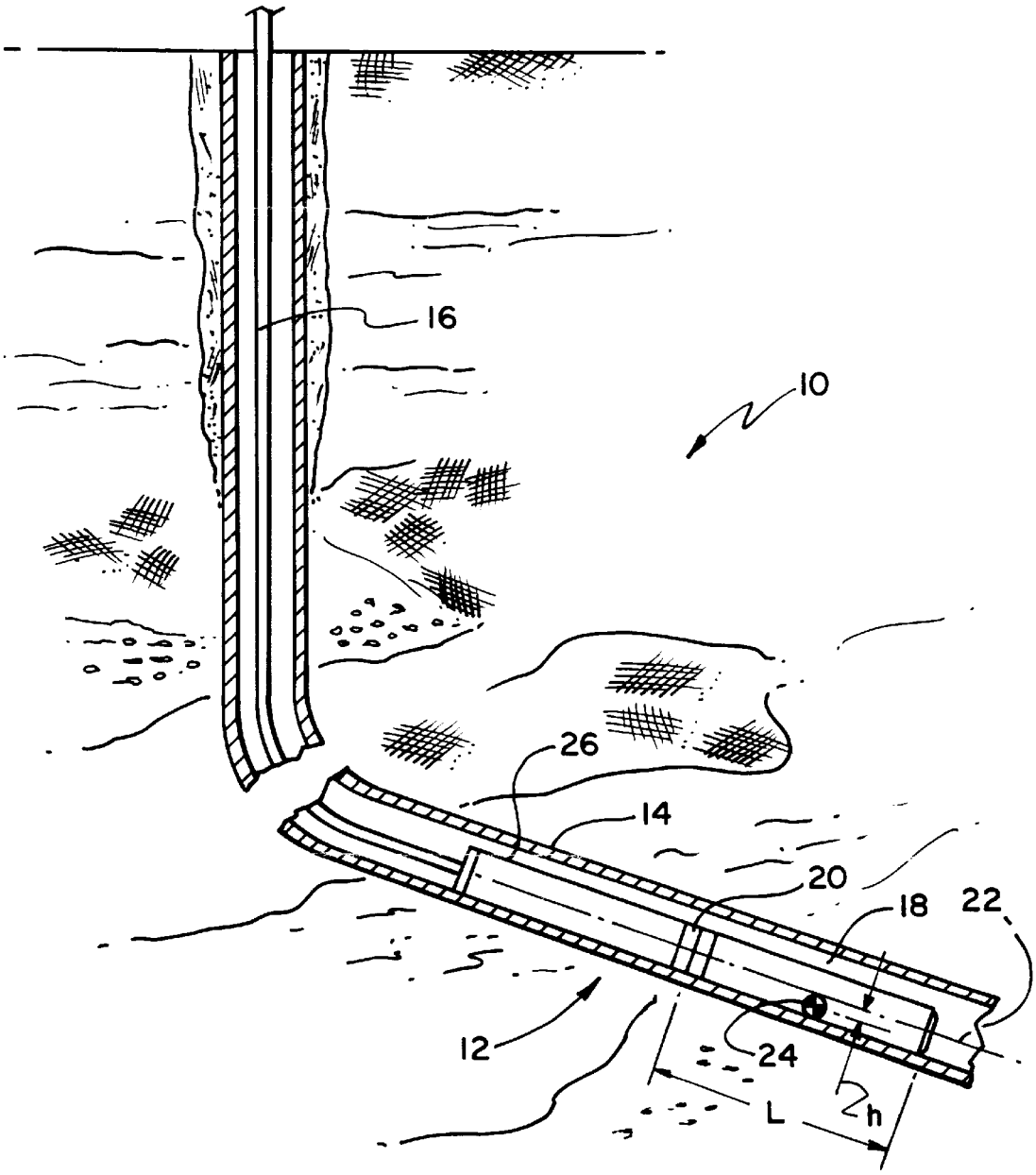
FIG. 1 illustrates a system with a rotatable tool for performing a downhole function in a well, according to the invention.

Referring to FIG. 1, a system 10 for performing a downhole function in a horizontal or highly deviated well comprises a string 12 of tools lowered into the well 14 on tubing 16. The string has a functional tool 18 suspended from a swivel 20 that allows tool 18 to rotate with respect to tubing 16 about a longitudinal axis 22. Tool 18 has an effective gravitational center 24 offset from axis 22 a distance h to apply a moment to cause the tool to rotate about axis 22 with respect to well 14 to position gravitational center 24 below axis 22, as shown, to orient tool 18 in a desired position for performing an associated function. The induced rotational moment is sufficient to overcome rotation-resisting friction between tool 18 and the inner surface of well 14. In other embodiments (not shown), tool string 12 has several tools 18 connected in series with associated swivels 20, each tool being independently orientable in a preferred direction by offset gravitational centers 24.

In the preferred embodiment (see also FIGS. 2 and 3), tool 18 is a detonatable gun, and swivel 20 connects gun 18 to a hydraulically activatable firing head 26. Firing head 26 is activated to detonate gun 18 by pressure conditions received via tubing 16 from the top of the well, detonating gun 18 to perforate well 14 to access product-bearing formations. As tool string 12 is lowered down the well, swivel 20 enables gun 18 to rotate under gravitational forces until its gravitational center 24 is below the axis 22 of rotation, placing perforating charges inside the gun in a preselected orientation to perforate the well.

Figure 2:
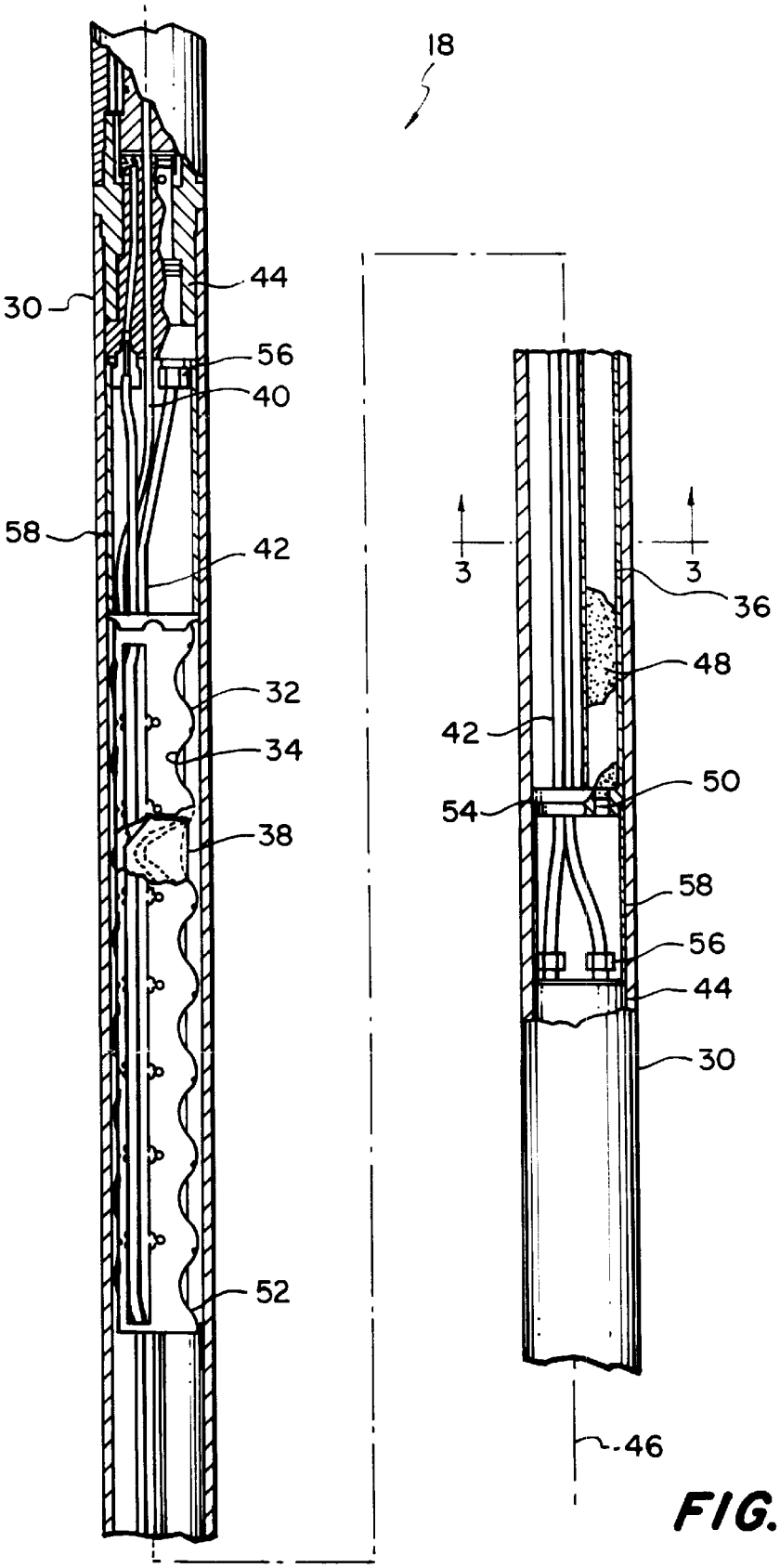
FIG. 2 is a partial cutaway view of a ballasted perforating gun.
Figure 3:
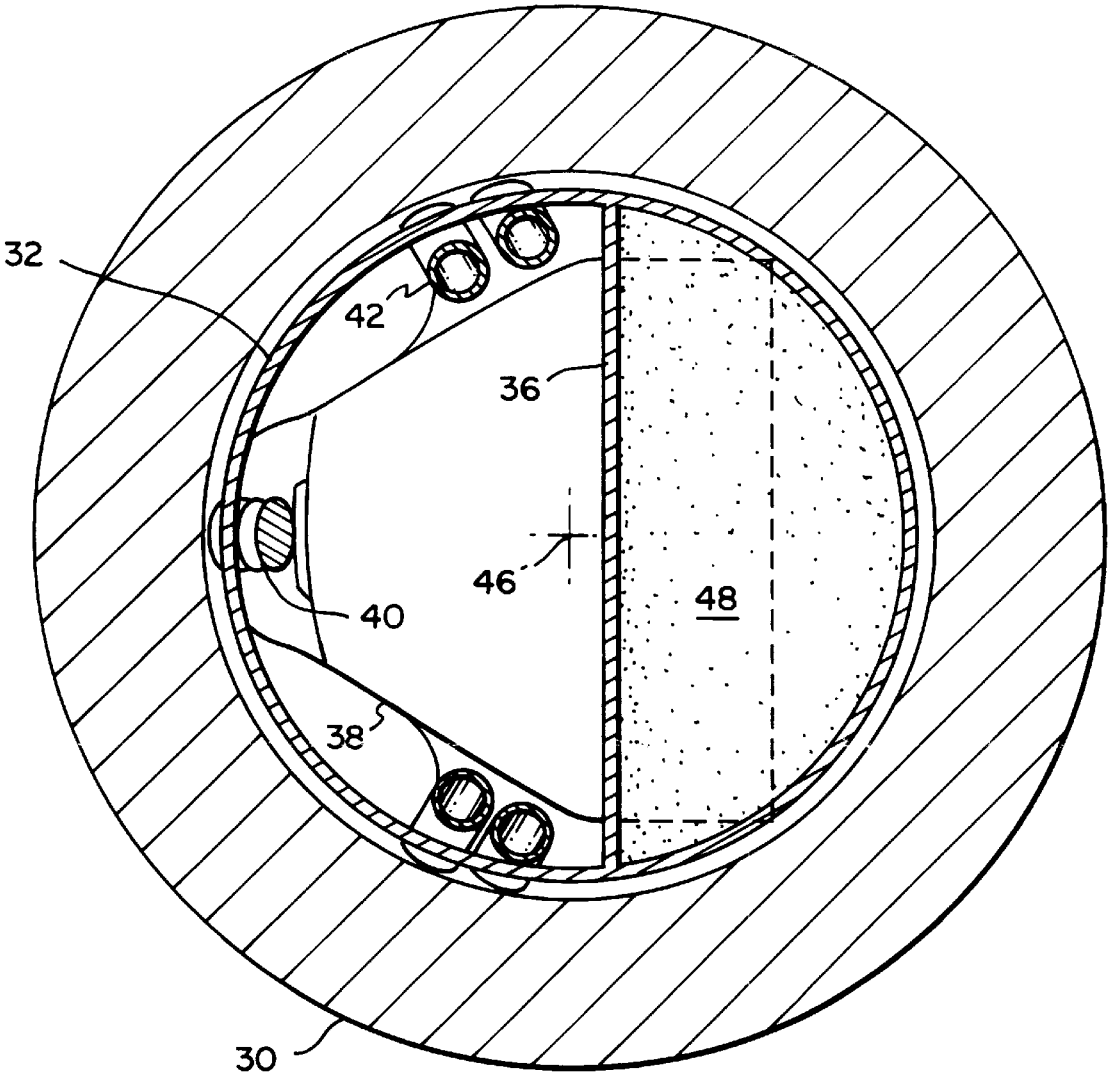
FIG. 3. is a cross-sectional view of the gun, taken along line 3—3 in FIG. 2.

Referring to FIGS. 2 and 3, gun 18 has an outer housing assembly 30 containing a loading tube assembly 32 with multiple charge-holding cavities 34 and an offset ballast chamber 36. Perforating charges 38 are placed in cavities 34 during assembly, and when detonated, blow holes in housing assembly 30 and the adjacent well casing. A detonating cord 40 is employed to communicate a detonation wave from the associated firing head to detonate the individual charges 38 within the gun. In the case of FIG. 2, gun 18 is to be used in a string above other hydraulically activatable firing heads, and therefore has internal hydraulic lines 42, and hydraulic bulkheads 44 at each end of the gun, to provide a hydraulic path through gun 18 for activating the lower firing heads.

Ballast chamber 36 is offset to one side of gun 18 (FIG. 3) so that the effective gravitational center of the gun will be offset from its longitudinal axis 46. Chamber 36 is filled with a dense, flowable ballast material 48, most preferably tungsten or depleted uranium powder. A fill plug 50 in end cap 54 provides an access to fill chamber 36 with ballast material 48 during assembly, and in some instances to salvage ballast material 48 from the loading tube assembly 32 of a used gun. In the embodiment shown, chamber 36 is formed of thin wall steel tube welded at an upper end to charge holder frame 52, and at a lower end to loading tube end cap 54. In other embodiments, chamber 36 is clipped or otherwise fastened to remain fixed within the gun housing during use. Hydraulic fittings 56 connect lines 42 to bulkheads 44, which are separated from loading tube assembly 32 by split spacer tubes 58.

Tungsten and depleted uranium are preferable ballast materials because they have a relatively high material density (over 1000 pounds per cubic foot, more than twice as dense as steel), and are readily available in a flowable form. Their high density enables a sufficient rotating moment to be developed with material occupying a chamber of relatively small volume, shortening the required length of chamber 36, for example. Shortening the overall length of the rotating portion of the tool string helps to minimize the amount of friction that must be overcome at the interface with the casing wall resisting the rotation of the tool.

Figure 4:
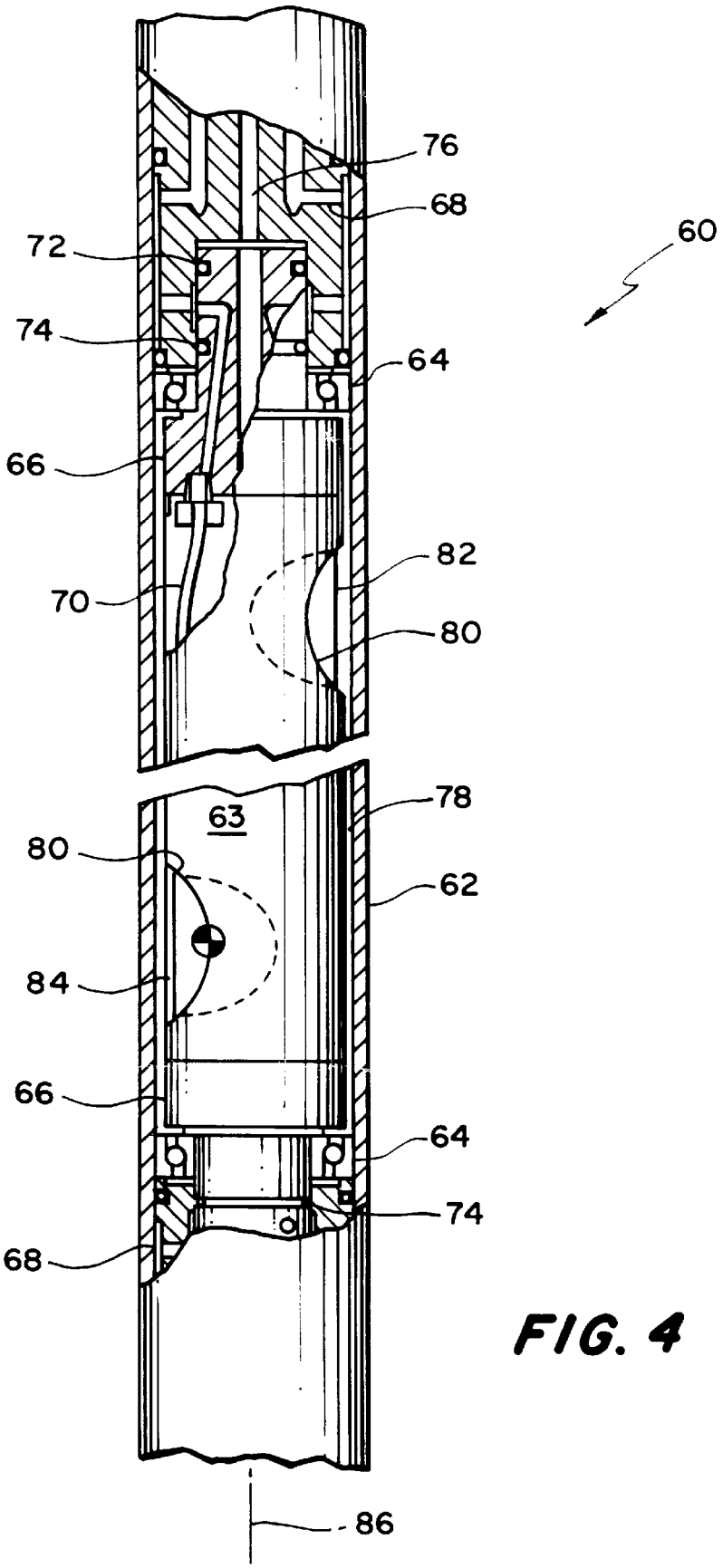
FIG. 4. is a partial cutaway view of a second embodiment of a ballasted perforating gun.

Referring to FIG. 4, in another embodiment of the invention a gun 60 has an outer housing assembly 62 and a freely rotatable inner loading tube assembly 63 supported by bearings 64. At each end of loading tube assembly 63 is a rotating hydraulic bulkhead 66 for hydraulic communication between a stationary hydraulic circuit 68 defined within housing assembly 62 and through-passing lines 70 within rotating loading tube assembly 63. Seals 72 and 74 at each end keep hydraulic activation fluid in circuit 68 from leaking into detonating cord cavity 76 or housing assembly annulus 78. Loading tube assembly 63 has multiple charge-holding cavities 80, each constructed to hold a perforating charge 82 or a ballast weight 84 that has a gravitational center offset from the rotational axis of the loading tube assembly. The cavities 80 of loading tube assembly 63 are arranged with charges 82 and weights 84 as required to provide an effectively offset gravitational center of loading tube assembly 63 to cause it to rotate on bearings 64 about axis 86 under gravitational forces to a preselected position. In some configurations, especially when the gun has a larger outer diameter than about 4 inches, the arrangement of charges 82 offset from the axis of rotation is sufficient to induce a moment of sufficient magnitude to rotate loading tube assembly 63 for downward firing, without any inert weights 84 being employed. In smaller diameter guns, the addition of a ballast weight enables the loading tube to be rotated to fire downward in configurations where the gravitational centers of the charges would otherwise rotate the loading tube to fire upward. In certain advantageous embodiments, weight 84 is a hollow, charge-shaped shell filled with the extremely dense, inert, flowable ballast material as previously described with reference to ballast chamber 36 (FIG. 2). The low rotational friction of bearings 64 enables loading tube assembly 63 to be easily rotated by gravitational forces to place charges 82 in a desirable orientation for perforating an adjacent well casing. Journal bearings or roller bearings may also be employed to support rotatable loading tube assembly 63, or the loading tube assembly may be allowed to rotate against a thin film of hydraulic activation fluid within housing assembly 62.

Referring back to FIG. 1, for embodiments of the invention in which the entire tool 18 rotates about axis 22 to a desired orientation, the length L of the tool below the swivel 20 is preferably short, e.g. less than about four feet, to minimize rotation-resisting frictional loads at the interface between tool 18 and the well 14. In many advantageous embodiments such shortness is achievable due to the highly effective moment-producing qualities of tungsten and spent uranium. It is advantageous, in certain circumstances, to place swivel 20 between a firing head 26 and a detonatable tool 18. Alternatively, swivel 20 can be placed above firing head 26, in which case both tool 18 and firing head 26 rotate with respect to tubing 16.

Figure 5:
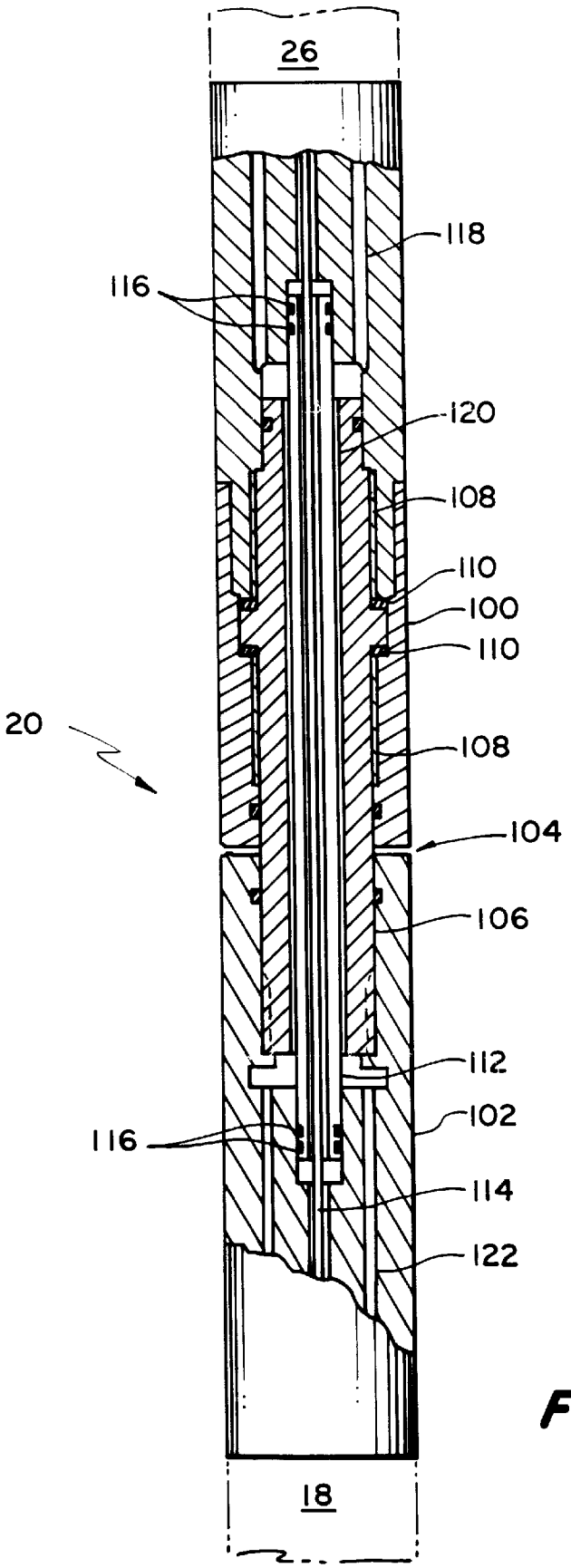
FIG. 5 is a partial cutaway view of a swivel according to the invention.

FIG. 5 illustrates a swivel 20 that provides separate explosive and hydraulic communications between a firing head and a detonatable tool in a tool string, enabling the swivel to be advantageously placed between the firing head and its associated tool to reduce the length of the rotating components of the string. Swivel 20 has an upper housing assembly 100 that rotates with firing head 26, and a lower housing assembly 102 that rotates with tool 18. The relative rotation of housing assemblies 100 and 102 occurs at joint 104. Attached to lower housing assembly 102 is a bearing shaft 106 that extends into upper housing assembly 100, where it is supported for rotation by radial journal bearings 108 and axial thrust bearings 110. A sealed detonator tube 112 extends between upper and lower housing assemblies 100 and 102 and carries a detonator cord 114 for transferring a detonation from firing head 26 to tool 18. In the current configuration, cord 114 is constructed with sufficient slack to enable it to be twisted as swivel 20 rotates. In other embodiments, either end or both ends of cord 114 are mounted in rotatable mounts to increase the allowable angular travel of the joint. A hydraulic path is defined through swivel 20 from firing head 26 along holes 118, down annulus 120 of bearing shaft 106, and down holes 122 to tool 18. Seals 116 keep activation fluid away from detonating cord 114. So constructed, swivel 20 is placed between a firing head 26 and a detonatable tool 18 to minimize the length L (FIG. 1) of the rotational part of the tool string, and therefore also the frictional drag of the rotational section against the well, without impeding either the explosive or hydraulic communication between the firing head and the tool.

According to certain broad aspects of the invention, the ballast material, e.g. 48 in FIG. 2, is an inexpensive substance having a material density greater than about 500 pounds per cubic foot. Lead, with a density of approximately 700 pounds per cubic foot, may be employed in shot form. Lead may also be poured in a molten form to eliminate porosity for greater effective density.

In many highly important embodiments the substance is heavier than lead, having a material density greater than about 1000 pounds per cubic foot. It is found that tungsten powder, with a material density of about 1200 pounds per cubic foot, is highly effective. The net density of the chamber, of course, also depends on the volumetric packing efficiency of the powder, which is affected by particle shape and settling. Depleted particulate uranium, with a material density over 1100 pounds per cubic foot, may also be employed. (As used herein with respect to the ballast material, the broad term 'flowable' refers to either a particulate material or a liquid, and includes materials that subsequently solidify after being poured into the ballast chamber.)

It should be understood that the ballast chamber for tools according to the invention are shaped according to the requirements of the particular application, and for achieving the required offset moment of the gravitational center of the rotatable structure. The two shapes shown represent presently preferred configurations that have advantages of being mechanically simple and compatible with existing designs.

The ballasting technique and the swivel of the invention, in other embodiments, are used separately and in combination with sensors, valves, seals and other downhole devices to rotate them to a desired orientation in a horizontal or highly deviated well.

What is claimed is:

1. A tool for use in a horizontal or deviated well, comprising a downhole structure having a longitudinal axis and rotatable about the axis, the structure including at least one ballast chamber containing a flowable ballast material, said chamber carried by said structure such that the gravitational center of the chamber is effectively offset from the longitudinal axis of the structure to enable rotation of the structure due to gravitational orientation within the horizontal or deviated well to a desire position.

2. The tool of claim 1 wherein said structure comprises a rotatable tube.

3. The tool of claim 1 wherein said chamber is elongated with an axis of the chamber lying substantially parallel to and offset from the axis of said structure.

4. The tool of claim 1 wherein said flowable material comprises high density particulate material.

5. The tool of claim 1 wherein said ballast material is selected from the group of elements having a material density greater than about 500 pounds per cubic foot.

6. The tool of claim 1 wherein said ballast material is selected from the group of elements having a material density greater than about 1000 pounds per cubic foot.

7. The tool of claim 1 wherein said ballast material comprises either tungsten or depleted uranium.

8. The tool of claim 1 wherein said ballast material is of particulate, flowable form.

9. A downhole gun for perforating the casing of a horizontal or deviated well, comprising a housing having a longitudinal axis; and a loading tube within said housing comprising at least one perforating charge, and at least one ballast chamber formed of a material having a first density offset from said axis and containing ballast material having a second density greater than the first density to contribute to rotation of the loading tube about said axis under gravitational forces until said chamber is positioned generally below said axis.

10. The downhole gun of claim 9, wherein the loading tube is rotatable with respect to the housing.

11. The downhole gun of claim 9, wherein rotation of the loading tube causes the downhole gun to rotate therewith.

12. A tool for use in a horizontal or deviated well, comprising a housing having a longitudinal axis; and a rotatable structure within said housing having a ballast chamber containing a flowable ballast material offset from said axis to contribute to rotation of the structure with respect to said housing about said axis under gravitational forces, the ballast chamber being formed of a material having a first density and the ballast material having a second density greater than the first density.

13. The tool of claim 12 further comprising at least one low friction bearing supporting said structure within said housing to enable free rotation of said structure with respect to said housing.

14. The tool of claim 13 comprising at least two spaced apart ball or roller bearings supporting said structure within said housing to enable free rotation of said structure with respect to said housing.

15. The tool of claim 12 further comprising a rotatable seal between said structure and said housing.

16. The tool of claim 12, wherein the ballast material comprises tungsten.

17. The tool of claim 12, wherein the ballast material comprises uranium.

18. A tool for use in a horizontal or deviated well, comprising:

a housing having a longitudinal axis;

a rotatable structure within said housing having a ballast chamber containing a ballast material offset from said axis to contribute to rotation of the structure with respect to said housing about said axis under gravitational forces; and a rotatable seal between said structure and said housing, the rotatable seal being at each of a first and a second end of said structure, said structure defining an internal hydraulic path between said first end and said second end.

19. A method of orienting a tool in a horizontal or highly deviated well, comprising filling a ballast chamber with a flowable ballast material, placing said ballast chamber into a swivelable tool housing having a longitudinal axis, with the gravitational center of said filled chamber effectively offset from said axis, and lowering said housing into said well, enabling said housing to rotate under gravitational forces acting upon said offset gravitational center of said filled chamber.

20. A downhole gun for use in a horizontal or deviated well, comprising:

a housing having a longitudinal axis; and a loading tube containing at least a first and a second cavity shaped to carry perforating charges, the first cavity containing a perforating charge and the second cavity containing a ballast weight, the perforating charge and ballast weight positioned so that the gravitational center of the perforating charge and ballast weight is offset from the longitudinal axis of the housing to contribute to the rotation of the loading tube.

21. A system for use in a horizontal or deviated well, comprising:

a rotatable downhole structure having a longitudinal axis; and an internal ballast in the structure having a flowable material with a density greater than about 500 pounds per cubic foot, the ballast being effectively offset to the axis to enable the ballast to contribute to rotation of the structure about the axis due to gravitational forces, to align the structure in a desired orientation in the horizontal or deviated well.

22. The system of claim 21, further comprising a swivel rotatably supporting the structure and enabling the structure to rotate about the axis.

* * * * *